US007328151B2

(12) United States Patent
Muesch

(10) Patent No.: US 7,328,151 B2
(45) Date of Patent: Feb. 5, 2008

(54) AUDIO DECODER WITH DYNAMIC ADJUSTMENT OF SIGNAL MODIFICATION

(75) Inventor: Hannes Muesch, San Francisco, CA (US)

(73) Assignee: Sound ID, Palo Alto, CA (US)

( * ) Notice: Subject to any disclaimer, the term of this patent is extended or adjusted under 35 U.S.C. 154(b) by 728 days.

(21) Appl. No.: 10/104,384

(22) Filed: Mar. 22, 2002

(65) Prior Publication Data

US 2003/0182104 A1 Sep. 25, 2003

(51) Int. Cl.
*G10L 21/02* (2006.01)

(52) U.S. Cl. ..... 704/228; 704/200.1; 381/312

(58) Field of Classification Search ..... 704/228
See application file for complete search history.

(56) References Cited

U.S. PATENT DOCUMENTS

| | | | | |
|---|---|---|---|---|
| 5,563,913 | A * | 10/1996 | Akagiri et al. | 375/243 |
| 5,684,922 | A * | 11/1997 | Miyakawa et al. | 704/229 |
| 5,710,863 | A * | 1/1998 | Chen | 704/200.1 |
| 5,752,222 | A * | 5/1998 | Nishiguchi et al. | 704/201 |
| 5,890,125 | A | 3/1999 | Davis et al. | 704/501 |
| 6,041,295 | A * | 3/2000 | Hinderks | 704/206 |
| 6,138,093 | A * | 10/2000 | Ekudden et al. | 704/228 |
| 6,226,608 | B1 | 5/2001 | Fielder et al. | 704/229 |
| 6,665,637 | B2 * | 12/2003 | Bruhn | 704/206 |
| 6,934,677 | B2 * | 8/2005 | Chen et al. | 704/200.1 |

FOREIGN PATENT DOCUMENTS

WO WO 00/19414 4/2000

OTHER PUBLICATIONS

Srinivasan "*High Quality Audio Compression Using An Adadptive Wavelet Packet Decomposition and Psychoaoustic Modelling*" Advanced Digital Video Compression Engineering Conference (ADVCE 97) Oxford, England Jul 1997.

Aggarwal et al. "*Perceptual Zerotrees for Scalable Wavelet Coding of Wideband Audio*" Proc. 1999 IEEE Workshop on Speech Encoding, Poconomomer, PA pp. 16-18 Jun. 1999.

Tewfik et al. "*Enhanced Wavelet Based Audio Coder*" Conf. Record of the 27th Asilomar Conference on Signals, Systems and Computers Pacific Grove, CA pp. 896-900 Nov. 1993.

* cited by examiner

*Primary Examiner*—Donald L. Storm
(74) *Attorney, Agent, or Firm*—Ernest J. Beffel, Jr.; Haynes Beffel & Wolfeld LLP

(57) ABSTRACT

Methods and devices for dynamically adjusting a multi-band signal-modification profile based on a psychoacoustic model are disclosed. In one arrangement, the encoding parameter side information is used to estimate encoding noise of an encoded signal. The signal spectrum of the signal is estimated. Adjustments to the multi-band signal-modification profile are determined using the estimated noise and signal spectrum and a psychoacoustic profile.

32 Claims, 2 Drawing Sheets

AUDIO DECODER WITH DYNAMIC ADJUSTMENT OF SIGNAL MODIFICATION

BACKGROUND OF THE INVENTION

1. Field of the Invention

The present invention relates to the field of sound enhancement during reproduction of previously encoded audio signals to compensate for hearing impairment, environmental or other factors and, more specifically, to dynamically adjust the degree of sound enhancement. Dynamic adjustment includes, in some embodiments, balancing the benefits of sound enhancement against possible detriments resulting from increased audibility of encoding noise.

2. Description of Related Art

The invention presented here relates to the application of sound enhancement means to previously compressed audio signals. Before discussing the invention in detail the state of the art in audio compression and sound enhancement is reviewed.

Audio compression refers to the process of reducing the number of bits required to represent a digitally sampled audio signal. In general, the higher the number of bits used to represent an audio signal of a given duration (bit rate), the higher the signal quality. If more bits are available to represent a signal of a given duration, the additional bits can be used to sample the signal more densely (i.e., take more samples per time interval), which results in capturing a wider frequency range of the signal. The additional bits can also be used to characterize the signal samples more accurately (i.e., to reduce the quantization error), which results in a lower quantization noise floor. Either approach by itself or a combination of the two will result in a more faithful representation of the signal. However, it is known from psychoacoustic experimentation that a more faithful representation of the audio signal does not necessarily translate into higher fidelity. This is due to the fact that parts of most signals are inaudible to human listeners because they are "masked", by other signal components. Exploiting this fact, a variety of audio-compression techniques have been developed that attempt to reduce the bit rate of an audio signal without affecting the perceived audio quality by selectively reducing the bit rate for signal components that are largely masked without affecting the bit rate of unmasked signal components. Examples of such audio-compression techniques are MPEG-1, Layer I, II, and III, Advanced Audio Coding (AAC; MPEG-2), AC-3 (Dolby) and Adaptive Transform Acoustic Coding (ATRAC; Sony). Typically, these techniques achieve their goal of reducing the overall bit rate without affecting fidelity by using fewer bits (i.e., by allowing a larger quantization error) for the representation of signal components that are estimated to have associated with them a high masked threshold while maintaining the original quantization accuracy for parts of the signal that are estimated to have associated with them a low masked threshold. Such an approach requires that the signal be represented in modular form. State of the art compressors parse the signal in time and represent different spectral regions separately. These separate signal parts are then quantized with different levels of accuracy (i.e., with different bit rates). The required degree of quantization accuracy in any signal part is determined by a psychoacoustic model that predicts whether quantization inaccuracies (the quantization noise) will be heard by the listener. Towards this end, the psychoacoustic model predicts the spectrum and temporal envelope of the broadband signal with the highest possible energy that is not audible when the signal that is to be coded is played simultaneously. In other words, the psychoacoustic model determines the highest-energy signal that is completely "masked" by the original signal. The spectrum of this signal is also known as the "spectral masked threshold" and the time course is known as the "temporal masked threshold". Once the psychoacoustic model has predicted the masked threshold, the bit rates for the various signal parts are selected. The objective of this selection is to choose the lowest bit rate for which the quantization error, when expressed as the power of an error signal, is smaller than the masked threshold. With such a bit rate allocation the resulting quantization error is imperceptible and the goal of reducing the overall bit rate without affecting fidelity has been achieved.

The term "sound enhancement", as used here, refers to the process of adjusting audio signals to compensate for an individual's altered sound perception. Sound perception may be altered (relative to that of a young, normally hearing listener in an anechoic quiet room) by hearing loss and/or the impact of environmental noise. To those skilled in the art it is well known that individuals with sensorineural hearing loss perceive the dynamics of an audio signal differently than listeners with normal hearing. (See, e.g., Minifie et al., Normal Aspects of Speech, Hearing, and Language ("Psychoacoustics", Arnold M. Small, pp. 343-420), 1973, Prentice-Hall, Inc.). Specifically, listeners with sensorineural hearing impairment cannot perceive faint sounds whose level is high enough to be clearly heard by normally hearing listeners, but is too low to be heard by the hearing impaired. On the other end of the level range, high-level sounds are perceived as loud by the normally hearing and by the hearing impaired alike. Both effects are a manifestation of the reduced dynamic range of the impaired auditory system. A hearing-impaired individual's perception of signal dynamics can be altered to more closely resemble that of normally hearing listeners by the use of properly adjusted multi-band dynamic range compression. (Lippmann et al., "Study of Multichannel Amplitude Compression and Linear Amplification for Persons with Sensorineural Hearing Loss," J. Acoust. Soc. Am. 69(2) (February 1981).) This kind of processing amplifies relatively faint audio signals to above an individual's elevated perception threshold, but does not amplify high-level signals, because those are already sufficiently loud. In summary, multi-band dynamic range compression maps the dynamic range of the signal onto the reduced (and warped) dynamic range of the hearing-impaired listener. By doing so the audibility of the desired sound, and hence the sound quality is greatly improved.

The compressor parameters, such as the compression threshold and the compression ratio, required to restore normal loudness perception depend on the amount of hearing loss and thus vary across frequency for hearing losses that are frequency dependent. Those skilled in the art are familiar with several methods of determining desired compressor settings for any given hearing loss profile (e.g., B. C. J. Moore, B. R. Glasberg and M. A. Stone: "Use of a loudness model for hearing aid fitting: III. A general method for deriving initial fittings for hearing aids with multichannel compression", British Journal of Audiology, 1999, Vol 33, p. 241-258).

Environmental factors also require compensation. Research suggests that the presence of broadband noise affects audio signals in much the same way as sensorineural hearing impairment in as much as it reduces the audibility of soft sounds without reducing the sensitivity to loud sounds (Braida et al., "Review of Recent Research on Multiband Amplitude Compression for the Hearing Impaired," in:

Studebaker, G. A., Bess, F. H., eds. The Vanderbilt Hearing-Aid Report, Upper Darby, Pa.: Monographs in Contemporary Audiology, 1982; 133-40). Therefore, travelers on planes, trains and automobiles, where various forms of background noises are encountered, also benefit from multi-band dynamic range compression.

Deliberately coloring a sound, for instance by applying a linear graphic equalizer, is another typical adjustment of an audio signal. Equalizing a sound may compensate for environmental conditions where the sound is reproduced or may suit the perception of the listener. Either equalizing a sound or adjusting it to compensate for listening impairment or environmental conditions can be described as applying a multi-band audio signal-modification profile, which describes how the signal is to be modified.

When a previously encoded audio signal is enhanced, (e.g., a decoded MP3 file is subjected to multi-band dynamic range compression) the masked threshold generated by the enhanced signal differs from the masked threshold that would have been generated by the original signal. Moreover, the signal enhancement algorithm works not only on the original signal but also "enhances" the quantization noise so that the quantization-noise spectrum differs from the quantization noise spectrum that would have been observed had the signal not been enhanced. Because the encoder assigned the quantization noise based on a masked threshold that differs from the masked threshold actually encountered and because the quantization noise spectrum differs from that intended by the encoder it is no longer guaranteed that the quantization noise remains inaudible. Accordingly, application of a signal-modification profile may make the perceived sound worse, instead of better, if too much encoding noise is promoted from a masked to an unmasked level. Whether the signal-modification profile is beneficial or not depends on the signal characteristics and will change rapidly over time.

Accordingly, there is an opportunity to introduce a dynamic signal-modification profile adjustment method and device that regulates the signal-modification profile to balance the positive effect of sound enhancement and the possible negative effect of increased quantization noise audibility. This method and device, which will be described in the following sections, will apply an auditory perception model during decoding and signal modification.

SUMMARY OF THE INVENTION

The present invention includes methods of and devices for signal modification during decoding of an audio signal and for dynamically adjusting a signal-modification profile based on a psychoacoustic model. Particular aspects of the present invention are described in the claims, specification and drawings.

DETAILED DESCRIPTION

The following detailed description is made with reference to the figures. Preferred embodiments are described to illustrate the present invention, not to limit its scope, which is defined by the claims. Those of ordinary skill in the art will recognize a variety of equivalent variations on the description that follows.

Reducing the bit rate of an audio signal without compromising fidelity is possible because every audible sound has the potential to mask (i.e., render inaudible) a set of signals. These masked signals can be either concurrent with the masking sound but at a different (usually higher) frequency (upward and downward spread of masking) or they can be of the same frequency as the masking sound but precede or follow it (temporal masking). As described in the section "Description of Related Art", audio coders reduce the bit rate of an audio data stream by reducing the number of bits spent on quantizing certain parts of the signal. By doing so they introduce quantization noise, which is the difference between the original signal and the quantized signal. The coders attempt to distribute the bit-rate reduction so that the resulting quantization noise is least obtrusive, i.e., most likely to be masked. This implies that the quantization noise is unevenly distributed in frequency and time. The quantized signal is then stored or transmitted together with side information that describes the quantization-noise assignment to the different signal parts.

The present invention will be described in the context of the perhaps best-known perceptual audio coding schema, the MPEG-1, layer 3 encoding standard, commonly referred to as MP3 "Information technology—coding of moving pictures and associated audio for digital storage media at up to about 1.5 Mbps—Part 3: Audio", ISO/IEC 11172-3 (1993). However, the present invention can be applied to any perceptually coded signal, not just MPEG-coded signals, as long as the distribution of the quantization noise can be deduced from the coded data stream. Furthermore, the present invention, which employs a psychoacoustic model, can use any past or future developed psychoacoustic model.

Figure 1:
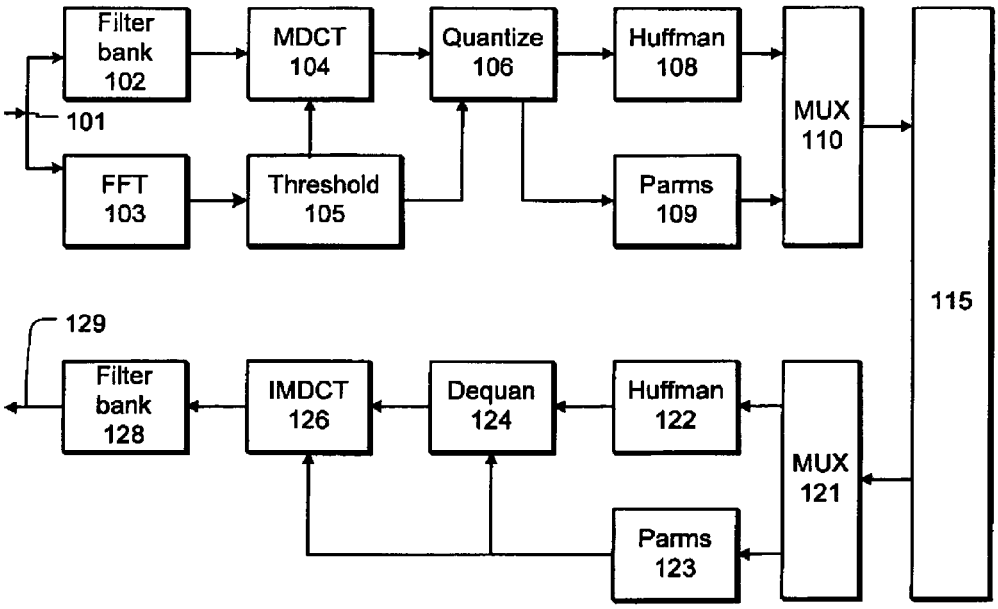
FIG. 1 Prior Art
FIG. 1 is a block diagram of encoding an audio stream, transmitting it across a digital channel, and decoding it.

FIG. 1 is a block diagram of an MP3 encoder and decoder. An MP3 audio encoder filters a PCM coded audio signal 101 into 32 spectral bands 102 and applies a modified discrete cosine transform (MDCT) to the output of each of these bands 104, thereby detailing the frequency composition of the signal further. Simultaneously, the audio signal 101 is transformed into the frequency domain by way of an FFT 103. The frequency representation of the signal is passed to the psychoacoustic model 105, which in effect calculates the spectrum of a temporally varying noise that is just not heard by a normally hearing observer listening in a noise-free environment to the signal being encoded 101. A quantizer 106 quantizes each of the spectral samples received from the MDCT 104. Using the output of the psychoacoustic model 105, the quantizer 106 shapes the quantization noise so that it falls below the masked threshold estimated by the psychoacoustic model 105. This is done by selectively scaling the signal components in a number of spectral regions before subjecting the scaled samples to a nonlinear transformation and rounding the resulting real numbers to integers. This rounding is equivalent to a quantization, and the relative quantization error depends on the proportion of the integer part and the fractional part. Thus the scaling is a means of controlling the quantization noise and the number of bits assigned for representing the sample. The quantized signal is subsequently Huffman coded 108 to reduce the data rate further without loss of information. The scaling information 109 and the Huffman coded data 108 are multiplexed 110 to form a stream of compressed audio data 115. The decoder parses the data stream 115 by means of a de-multiplexer 121 into the Huffman coded data and the parameters 123. The Huffman coded data 122 are decoded and subjected to the inverse of the nonlinear function and scaling that was applied in the quantizer. This process is known as dequantization 124. It requires knowledge of the scaling parameters which are provided as side information 123. The dequantized data are passed to the inverse MDCT 126, whose size depends on the temporal resolution used in the coding. This information is supplied by the side information 126. The output of the IMDCT 126 is passed to the synthesis filter 128, which reconstructs the audio signal 129.

One aspect of the present invention is to insert signal modification into the decoding process. Because the signal modification will often be frequency specific (e.g., multiband dynamic range compression), the signal modification procedure must have access to the various spectral parts of the signal. Therefore, signal modification algorithms that receive as input a time-domain signal such as that at the output of the decoder 129 must perform a spectral analysis of the signal (e.g., pass it through a filter bank) before they can apply the actual signal modification. The modified signal must then be transformed back into the time domain for presentation to the listener.

Figure 2:
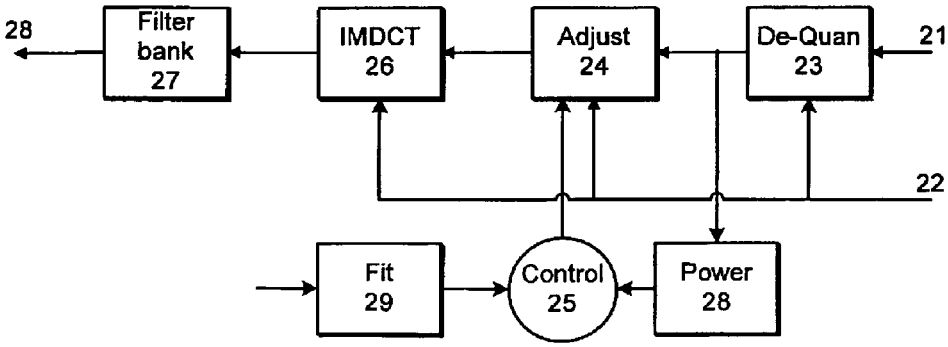
FIG. 2 is a block diagram of one placement of a dynamic adjustment in the decoding mechanism of FIG. 1. An alternative placement is depicted in FIG. 3.
Figure 3:
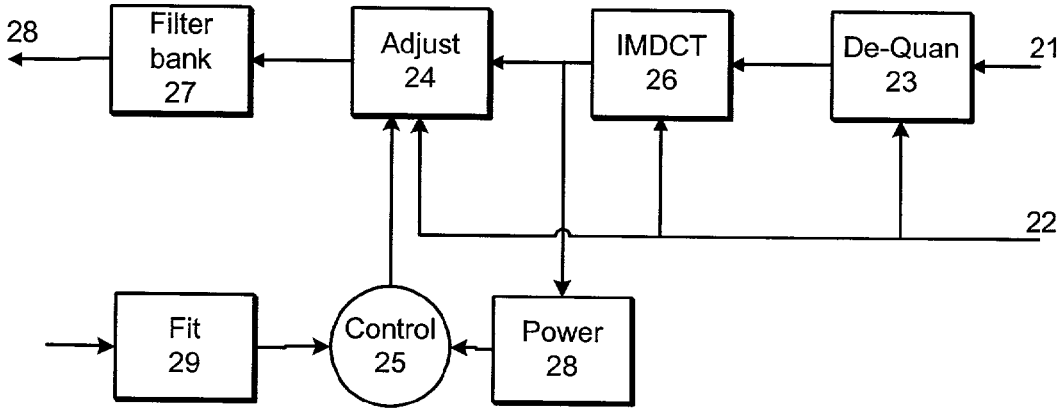

If such a signal-modification algorithm is applied to a signal that has been decoded and the decoder, at some point in the decoding process, represents the signal in the frequency domain, the signal-modification algorithm can be made part of the decoder, thereby saving the need for a time-to-frequency domain conversion and a frequency-to-time domain conversion. In such an implementation the signal-modification profile would be applied to the data in the frequency domain as found in the decoder. In the example of an MP3 decoder, the signal-modification profile could be applied to the MDCT coefficients (see part 24 in FIG. 2) or to the bandpass signals entering the synthesis filter bank 27 (see part 24 in FIG. 3). Applying a static signal-modification profile means adjusting the level of either the MDCT components (FIG. 2) or the inputs to the synthesis filter bank (FIG. 3), where, in the case of multiband dynamic range compression, the adjustment is temporally varying and determined by a controller 25. The controller derives the control signal, which is passed to the adjustment 24, from parameters being derived from the signal 28 and parameters being derived from the hearing status of the listener 29. An example of a parameter being derived from the signal is a vector of the short-term power estimates in the case of a multi-band dynamic range compressor. In FIG. 3, the input to power estimating 28 may alternatively be after de-quantization 23 and before the IMDCT 24. An example of a parameter being derived from the hearing status of the listener is a vector of compression ratios.

Another aspect of the present invention pertains to dynamically adjusting the signal-modification profile. As discussed earlier, modifying the decoded signal affects the signal and coding noise in such a manner that the assumptions of the psychoacoustic model in the encoder, which underlie the assignment of coding noise, potentially become invalid. Thus, the application of a signal-modification profile can, at least temporarily, increase the audibility of coding artifacts beyond levels that are observed without the application of the signal-modification profile. Therefore, there exists the opportunity to dynamically adjust the signal-modification profile so as to balance the benefits of signal modification and the detriments of increased audibility of coding noise that may result from the application of the signal modification. In that manner the benefits resulting from the signal modification can be enjoyed as long as applying the signal-modification profile does not increase the audibility of the coding noise to an objectionable degree. Whether the baseline signal-modification profile makes coding noise audible depends on (1) the signal, (2) the coding noise (as assigned by the encoder), and (3) the hearing threshold of the listener. The signal modification being applied is temporarily reduced when application of the original signal-modification profile would result in added audibility of coding noise that would counteract and outweigh the benefits intended by the signal modification.

Figure 4:
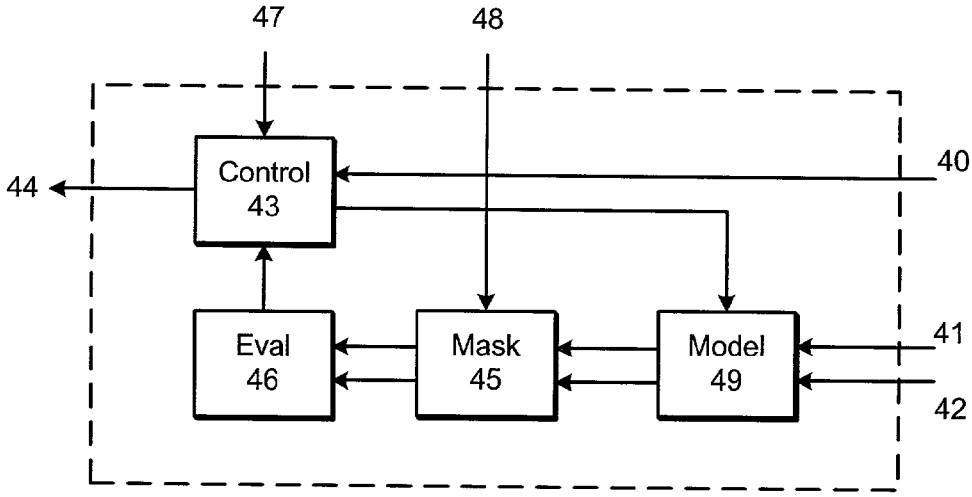
FIG. 4 is a block diagram of an iterative implementation of dynamically adjusting a signal-modification profile.

FIG. 4 depicts an embodiment of dynamically adjusting a signal-modification profile based on a psychoacoustic model. An initial signal-modification profile 40 is loaded into the control 43. A control parameter 47 may be applied to adjust the functioning of the control. In the first iteration, the control 43 supplies the initial signal-modification profile 40 to a model 44 of the signal-modification unit (e.g., a model of a multiband dynamic-range compressor). This model 44 estimates from the spectrum of the audio signal 41 the spectrum of the output signal that would result if the signal-modification profile 40 were applied to the signal. Simultaneously, the model of the signal-modification unit 44 also estimates the spectrum of the encoding noise that would be observed if the signal modification 40 was applied to the decoded signal. Towards this end, the model receives as input an estimate of the encoding noise spectrum 42. Estimates of the signal spectrum and the encoding noise spectrum after application of the signal modification 40 are passed to a psychoacoustic model 45. The psychoacoustic model 45 may assume normal hearing or can be adjusted to reflect an individual's hearing profile or the acoustic environment 48 that impacts the audibility of sound. The psychoacoustic model determines the audibility of the encoding noise in the signal that would be observed if the signal-modification profile had been applied. The estimated audibility of the coding noise and the signal are evaluated in 46, which provides a measure of the benefit of the signal modification and a measure of the detriment resulting from increased coding-noise audibility. These measures are passed to the controller, which decides whether and how the initial signal-modification profile 40 should be adjusted. The controller's behavior may be influenced via a control parameter 47. This control parameter could, for example, determine the relative importance that is given to any predicted change in signal-modification benefits and detriments. If the controller finds that the detriments of signal modification outweigh the benefits, it adjusts the signal-modification profile. The adjusted signal-modification profile is passed to the model 44 to begin a new iteration. Once the iteration has converged to satisfy the constraint given by the control parameter 47, the newfound signal-modification profile 49 is passed to the adjustment 24. One auditory perception model that can be used is a model based on excitation levels, an excitation level based model or excitation model, for short. The "excitation level" is understood by those of skill in the art to refer to the excitation of the basilar membrane of the cochlea, which responds in different sections to different frequencies of sound. See, e.g., Mechanisms underlying the frequency discrimination of pulsed tones and the detection of freauency modulation, 86 J. Acoust. Soc. Am. No. 5, pp. 1722-32 (Nov. 1989); Detection of decrements and increments in sinusoids at high overall levels, 99 J. Acoust. Soc. Am. No. 6, pp. 3669-77 (June 1996).

The embodiment of FIG. 4 extends to adjustments of a sound-modification profile whenever information is available from which the power of the encoding noise can be estimated. The following explains one way of estimating the power of the coding noise from the incoming data stream.

In general, the power of the quantization noise, $\sigma_q^2$, is given as $$\sigma_q^2 = \int_{-\infty}^{+\infty} (x - Q[x])^2 \, p(x) dx, \tag{1}$$

where x denotes the signal value to be quantized, p(x) denotes the probability density function describing the distribution of signal values, and Q[x] denotes the quantization process of signal value x. The difference q=(x−Q[x]) is the quantization error of a signal sample of value x. The maximal value of the quantization error q is |max(q)|=Δ/2, where Δ represents the quantization step size or resolution of the quantizer. The resolution depends on the range R of signal levels to be quantized and on the number of bits, b, used for quantization:

$$\Delta = R/2^{b+1}$$

The number of bits, b, used to represent a sample is known at the decoder and the range R can be deduced from the scale factor that had been applied by the encoder. The probability density function of the signal values at the input of the quantizer p(x) can either be approximated based on a priori knowledge of the signals being transmitted or can be estimated from the distribution of the quantization-noise-corrupted received samples. Once the power of the quantization noise has been estimated, the power of the noise free signal (SP) can be estimated as $SP=10*\log_{10}(10^{OP/10}+10^{QNP/10})$, where OP is the overall power of signal and noise in dB and QNP is the estimate of the quantization-noise power (in dB) alone.

Some quantizers perform a non-linear transformation on the signal prior to quantization and the inverse transform at the beginning of the decoding process ("dequantization"). The effect of these transformations on p(x) must be taken into account.

In some cases it may be impossible to find a closed-form solution to express Eq. 1 or its components. In such cases tables of the average quantization noise may be found for different scale factors by straightforward testing. The resulting tables can be stored in the decoder. Examples of tables suitable for use in a MPEG1 layer II or I decoder can be found in tables C5 and C2 of ISO/IEC 11172-3 (1993), respectively.

The principle of the present invention can also be applied to other perceptually based encoding methods. Other methods include signal decomposition with wavelets (Lou and Sherlock, "High-quality Wavelet-Packet Based Audio Coder with Adaptive Quantization," Advanced Digital Video Compression Engineering Conference (Advice 97) Oxford, England, July 1997) and encoding using zero trees ("Perceptual Zerotrees for Scalable Wavelet Coding of Wide Band Audio," Proceedings of 1999 IEEE Workshop on Speech Encoding, Pocono Maner, Pa. pp. Jun. 16-18, 1999). Most generally, the present invention can be applied to any presently existing or future developed audio encoding that includes information from which encoding noise can be estimated.

The auditory perception models presented by model 1 and model 2 of the MPEG-1 standard may be used with the methods and devices disclosed.

While some embodiments involve restricting the signal-modification profile so that the encoding noise would remain inaudible or nearly inaudible, other embodiments may trade off costs and benefits. Alternatively, a penalty function can be introduced that is a transformation of a signal-quality degradation measure, such as the partial loudness of the coding noise. The benefit of the signal modification can also be quantified, e.g., as a transformation of an importance-weighted audibility measure such as the Speech Intelligibility Index (SII, ANSI S3.5, 1997). From these cost and benefit functions, a trade-off function can be build, e.g., as the weighted sum of the cost and benefit functions. Part 46 then applies this trade-off function and uses the evaluation to select the signal-modification procedure.

A further aspect of the present invention is the component of an audio device that dynamically modifies a signal-modification profile based on an auditory perception model. This component comprises a processor having an input. The processor may be a general purpose processor, a digital signal processor such as a fixed or floating point DSP, or other logic device such as a gate array. The input receives a stream of data representing an encoded audio signal, including encoding parameter data. The device then processes the data according to the method described above. As with the method, this component can be applied to a wide range of encoded audio signals, provided that information is available from which encoding noise can be estimated.

An article of manufacture practicing aspects of the present invention may include a program-recording medium on which a program is impressed that carries out the methods described above. It may be a program transmission medium across which a program is delivered that carries out the methods described above. It may be a component supplied as an accessory to enhance another audio device, carrying out the methods described above, such as a daughter board or feature chip. It may be a logic block available for incorporation in a signal processing system that carries out the methods described above.

While the present invention is disclosed by reference to the preferred embodiments and examples detailed above, it is understood that these examples are intended in an illustrative rather than in a limiting sense. It is contemplated that modifications and combinations will readily occur to those skilled in the art, which modifications and combinations will be within the spirit of the invention and the scope of the following claims.

I claim:

1. A method of dynamically modifying a signal-modification profile to account for noise, including:

providing an auditory perception model;

providing a multi-band audio signal-modification profile;

receiving a stream of data including an encoded audio signal and encoding parameter data;

estimating a signal spectrum of the stream of data that has been received;

estimating encoding noise based on the encoding parameter data that has been received;

determining profile adjustments for the audio signal-modification profile in one or more frequency bands based on at least the estimated signal spectrum, the estimated encoding noise and the auditory perception model;

applying the adjustments to the audio signal-modification profile in the one or more frequency bands; and processing the encoded audio signal using the audio signal-modification profile after adiustments.

2. The method of claim 1, wherein the auditory perception model comprises an excitation level based model.

3. The method of claim 2, wherein the excitation model takes into account temporal masking.

4. The method of claim 1, wherein the auditory perception model comprises a psychoacoustic model 1 or 2 of an MPEG-1 standard.

5. The method of claim 1, wherein the multi-band audio signal modification profile comprises linear band-wise equalization.

6. The method of claim 1, wherein the multi-band audio signal modification profile comprises an auditory profile of a particular listener.

7. The method of claim 1, wherein the multi-band audio signal modification profile comprises an auditory profile adapted to a hearing loss.

8. The method of claim 1, wherein the multi-band audio signal modification profile comprises an auditory profile adapted to an environmental background sound that causes masking.

9. The method of claim 1, wherein the stream of data represents 32 or more spectral bands.

10. The method of claim 9, wherein the stream of data complies with an MPEG standard.

11. The method of claim 9, wherein the stream of data complies with an MPEG-1 layer 3 standard.

12. The method of claim 1, wherein the encoding parameter data includes quantization numbers.

13. The method of claim 12, wherein the stream of data complies with an MPEG standard.

14. The method of claim 12, wherein the stream of data complies with an MPEG-1 layer 3 standard.

15. The method of claim 1, wherein the determining profile adjustments applies the auditory perception model to determine an adjustment that does not promote encoding noise to audible levels.

16. The method of claim 15, wherein the profile adjustments are determined iteratively.

17. A component device that dynamically modifies a multi-band audio signal-modification profile responsive to an auditory perception model, including:

a processor having an input, the input receiving a stream of data including an encoded audio signal and encoding parameter data;

logic operable on the processor to estimate a signal spectrum from the stream of data that has been received;

estimate encoding noise based on the encoding parameter data that has been received;

determine profile adjustments for the multi-band audio signal-modification profile in one or more frequency bands based on the estimated signal spectrum, the estimated encoding noise and the auditory perception model; and apply the adjustments to the audio signal-modification profile in the one or more frequency bands.

18. The device of claim 17, wherein the auditory perception model comprises an excitation level based model.

19. The device of claim 18, wherein the excitation model takes into account temporal masking.

20. The device of claim 17, wherein the auditory perception model comprises a psychoacoustic model 1 or 2 of an MPEG-1 standard.

21. The device of claim 17, wherein the multi-band audio signal modification profile comprises linear band-wise equalization.

22. The device of claim 17, wherein the multi-band audio signal modification profile comprises an auditory profile of a particular listener.

23. The device of claim 17, wherein the multi-band audio signal modification profile comprises an auditory profile adapted to a hearing loss.

24. The device of claim 17, wherein the multi-band audio signal modification profile comprises an auditory profile adapted to an environmental background sound that causes masking.

25. The device of claim 17, wherein the stream of data represents 32 or more spectral bands.

26. The device of claim 25, wherein the stream of data complies with an MPEG standard.

27. The device of claim 25, wherein the stream of data complies with an MPEG-1 layer 3 standard.

28. The device of claim 17, wherein the encoding parameter data includes a number of bits used to quantize a spectral band.

29. The device of claim 28, wherein the stream of data complies with an MPEG standard.

30. The device of claim 28, wherein the stream of data complies with an MPEG-1 layer 3 standard.

31. The device of claim 17, wherein the determining profile adjustments applies the auditory perception model to determine an adjustment that does not promote encoding noise to audible levels.

32. The device of claim 31, wherein the profile adjustments are determined iteratively.

* * * * *